United States Patent [19]

England

[11] Patent Number: 4,571,754

[45] Date of Patent: Feb. 25, 1986

[54] TOILET STRUCTURE FOR WALKER

[76] Inventor: Robert W. England, 1312 Rainier, Grandview, Wash. 98930

[21] Appl. No.: 477,600

[22] Filed: Mar. 21, 1983

[51] Int. Cl.[4] ..... A47K 11/06

[52] U.S. Cl. ..... 4/480; 4/449; 248/154

[58] Field of Search ..... 4/449, 480, 462, 463, 4/479, 481–484, 144.1, 457, 478; 135/65–67; 248/150, 155 R, 128–130, 154; 297/118

[56] References Cited

U.S. PATENT DOCUMENTS

| | | | |
|---|---|---|---|
| 1,917,440 | 7/1933 | Finkbeiner et al. | 135/67 X |
| 3,273,841 | 9/1966 | Cota | 248/154 |
| 3,327,324 | 6/1967 | Marsch | 4/449 |
| 3,341,864 | 9/1967 | Wickman | 4/480 X |
| 3,586,276 | 6/1971 | O'Mahoney | 248/128 |
| 3,829,908 | 8/1974 | Thomas | 4/483 |
| 3,854,773 | 12/1974 | Thomas | 4/480 |
| 4,032,998 | 5/1977 | England | 4/449 |
| 4,074,683 | 2/1978 | Di Chiara | 135/67 |
| 4,162,101 | 7/1979 | McCague et al. | 135/67 X |

FOREIGN PATENT DOCUMENTS

| | | | |
|---|---|---|---|
| 1478137 | 6/1977 | United Kingdom | 135/67 |

*Primary Examiner*—Charles E. Phillips

*Attorney, Agent, or Firm*—Wells, St. John & Roberts

[57] ABSTRACT

Disclosed is a standup toilet which can be directly incorporated into or attached to a conventional walker. The walker provides good stability both for the standup toilet and the person who is using it. The toilet structure has a frame with a support arm which can preferably be pivoted between a horizontal support position and a vertical position. The toilet frame can advantageously have a hook end and an attachment means to facilitate easy attachment and detachment of the frame from the walker.

15 Claims, 5 Drawing Figures

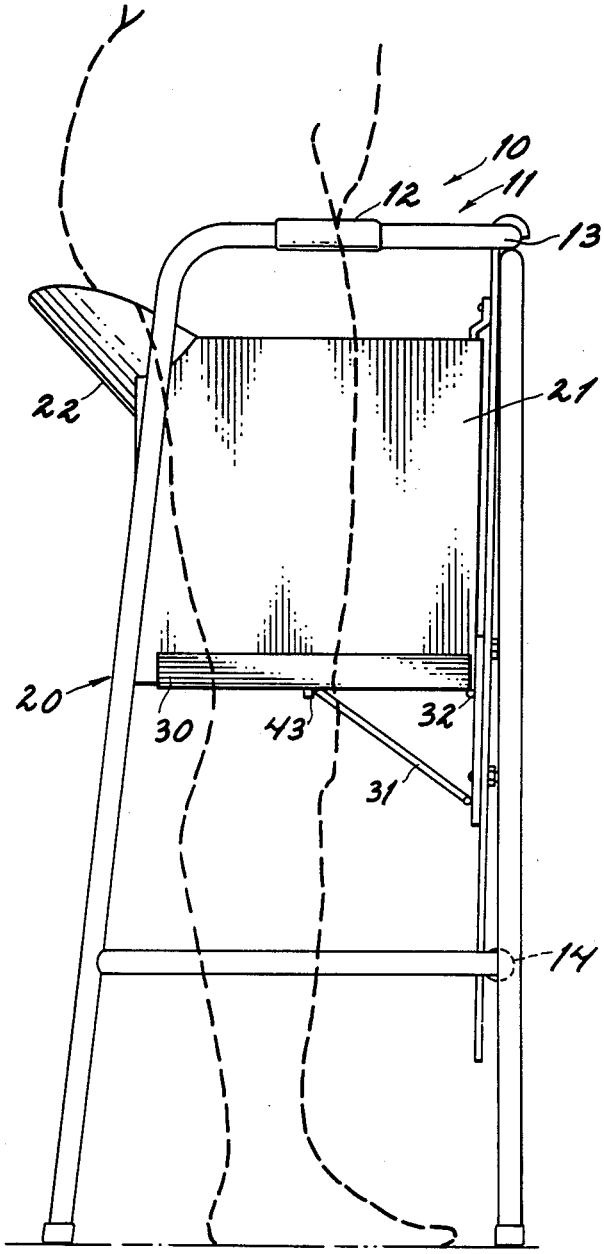
FIG 1
FIG 2
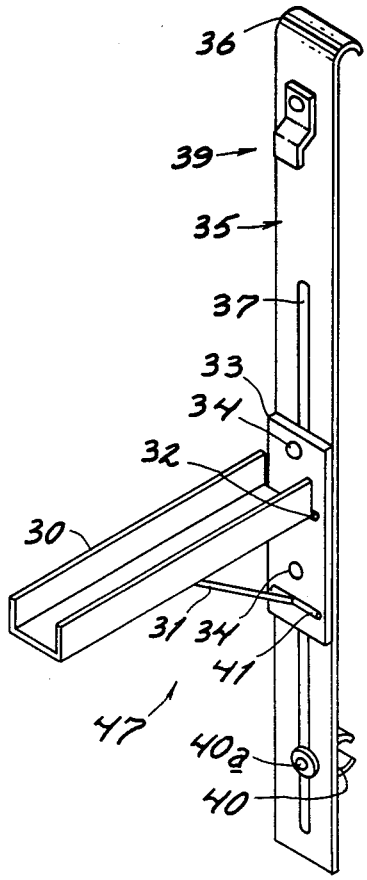

FIG 3
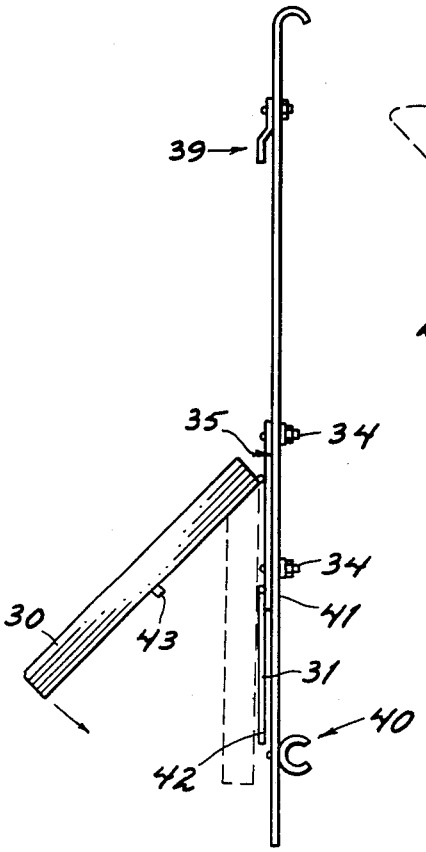
FIG 5
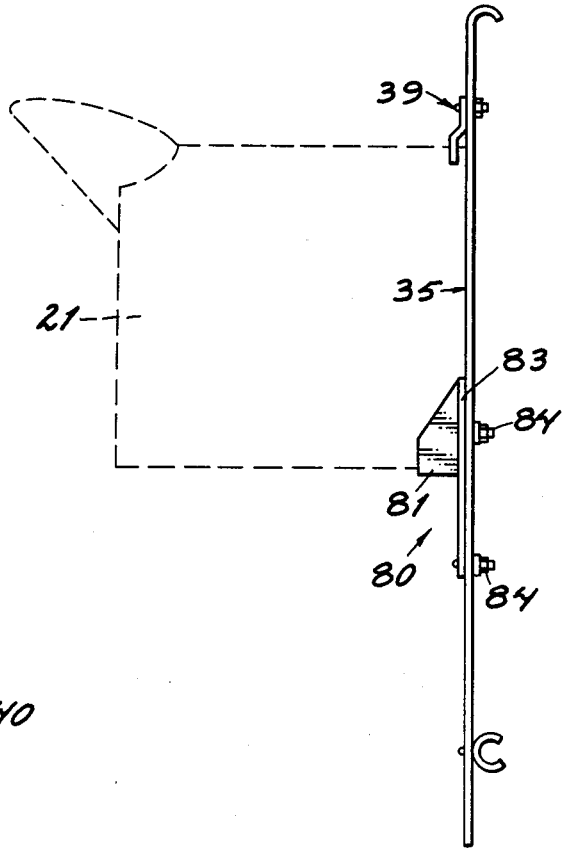
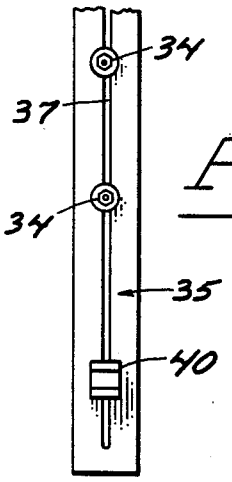
FIG 4

TOILET STRUCTURE FOR WALKER

TECHNICAL FIELD

The technical field of this invention is standup portable toilets.

BACKGROUND OF THE INVENTION

Many disabled and injured persons are unable to use a conventional toilet. In many cases, these individuals are able to use a standup toilet. The term standup toilet refers to a toilet which can be used while the person is standing. Such standup toilets are particularly useful to people who have back injuries which prohibit them from bending at the hips.

Standup toilets are not new and the prior art includes several different forms. One prior art standup toilet is shown in U.S. Pat. No. 3,327,324 to Marsch. The Marsch standup toilet has a tripodal foot arrangement with an upstanding central pillar which is adjustable in height. The central pillar supports a toilet receptacle having a somewhat rounded hourglass shape in plan view.

Another standup toilet is shown in U.S. Pat. No. 4,032,998 to myself. My previous standup toilet had a framework which supported a relatively thin toilet receptacle. This previous standup toilet suffered from the difficulty that many disabled or injured persons were not able to satisfactorily use the toilet because they could not easily support themselves both in gaining access to the toilet and in using it. My prior standup toilet also was relatively unstable and subject to tipping. This precluded it from acting as a support for the user. My earlier toilet also required a stand which served no purpose other than to support the toilet receptacle. This increased the cost of the toilet and required that a storage place be created for the stand.

My new invention solves the stability problem by providing a standup toilet which can either be attached to or incorporated directly into a walker. Such walkers are widely used by elderly and handicapped persons in assisting them in walking. Other important advantages and objectives of the invention will be apparent from the following description of the invention.

BRIEF DESCRIPTION OF THE DRAWINGS

A preferred and alternate embodiment of this invention is illustrated in the accompanying drawings, in which:

FIG. 1 is a side elevational view of a walker having a detachable standup toilet structure according to this invention attached thereto;

FIG. 2 is an isometric view showing the frame of the standup toilet shown in FIG. 1;

FIG. 3 is a side elevational view of the standup toilet frame shown in FIG. 2;

FIG. 4 is a partial front elevational view of the lower portion of the frame shown in FIGS. 1 through 3; and FIG. 5 is an alternative embodiment of the standup toilet frame.

DETAILED DESCRIPTION OF THE PREFERRED EMBODIMENTS

In compliance with the constitutional purpose of the Patent Laws "to promote the progress of science and useful arts" (Article 1, Section 8), applicant submits the following disclosure of the invention.

FIG. 1 shows a walker 10 which has a walker framework 11. The walker framework 11 has attached handles 12 which can be easily grasped by the person using the walker. The walker framework 11 also includes an upper front cross bar 13 and a lower front crossbar 14. The back of the walker is open so that a person can step into the three sided framework as he or she walks with the assistance of the walker.

The walker relates to my new standup toilet structure in that it provides a perfect structure for stabilizing both the standup toilet and the user who is trying to use the toilet. FIG. 1 shows one embodiment of my standup toilet which is specifically adapted for the walker structure shown therein. The standup toilet 20 has a toilet receptacle 21 which includes a deflector 22 at the rearward top end thereof. Toilet receptacle 20 rests upon a support arm 30 which is pivotally connected to an adjustable sliding plate 33 at pivot 32. Pivot 32 allows support arm 30 to swing from the approximately horizontal position represented in FIGS. 1 and 2, downwardly into an approximately vertical position shown in phantom in FIG. 3. Support arm 30 preferably has a channel cross-sectional shape which receives the bottom of receptacle 21 and prevents it from moving laterally.

Support arm 30 is maintained in the approximately horizontal position by using a strut 31 which is pivotally attached to sliding plate 33 at pivot 41. The distal end 42 of strut 31 is secured under support arm 30 at latch means 43 so that support arm 30 is securely held in the approximately horizontal position. Latch means 43 can be a small block or other piece which receives the end of strut 31 or prevents it from moving.

The support arm 30, sliding plate 33, and strut 31 form a support arm assembly 47 which is adjustably mounted upon a bar 35. Bar 35 has a slot 37 which receives fasteners 34 of the support arm assembly. Fasteners 34 extend through slot 37 and are tightened in order to fix the position of support arm assembly 47 at the desired height along bar 35.

Bar 35 comprises the principal component of the frame of the standup toilet which also includes the support arm assembly 47. Bar 35 preferably includes a hooked end 36 which allows the toilet frame to be hung upon the upper front crossbar 13 of walker 10. The lower end of bar 35 is preferably attached to the walker frame 11 using an attachment means 40. Attachment means 40 is preferably a C-shaped structure which can be snapped over the lower front crossbar 14. Attachment means 40 is preferably adjustable along bar 35 and can be advantageously mounted to bar 35 using slot 37 and fastener 40*a*.

Bar 35 also has a catch means 39 which extends outwardly and backwardly from the rear side of the bar and extends over the top front edge of the toilet receptacle 21 to restrain the receptacle near the toilet frame.

FIG. 5 shows an alternative embodiment of the invention wherein the support arm assembly 47 has been replaced with an alternative embodiment of the support arm assembly 80. This alternative support arm assembly 80 has a support arm 81 which is integral with or securely attached to the sliding plate 83. Sliding plate 83 has fasteners 84 extending therethrough to secure the support arm assembly 80 to bar 35 as described above. The toilet receptacle 21 is shown in phantom and rests with its front lower corner upon the support arm 81 with the upper front edge being restrained by catch means 39. This alternative structure for the support arm assembly allows the toilet frame to be continuously mounted upon the walker without adjustment of the support arm upwardly or downwardly between the approximately horizontal and approximately vertical positions discussed above. The support arm 81 extends rearwardly only a short distance thereby preventing it from obstructing the ordinary use of the walker which might occur if a longer support arm, such as shown in FIG. 1, was left in the horizontal position while the walker was used as a walking aid.

The description given above discloses two embodiments of a toilet frame which can be attached and removed from a walker framework. The invention also contemplates a wide variety of such attachable and detachable frames which will be apparent to one of ordinary skill in the art.

This invention also includes a walker which has a standup toilet frame incorporated directly into the walker framework 11. A wide variety of toilet frames could be directly incorporated within the walker framework 11 while still allowing the relatively thin toilet receptacle 21 to be used thereon. Such incorporated or attachable toilet structures are within the contemplation of this invention.

The standup toilet of this invention is conveniently used by having the user position himself or herself within the walker framework 11 as shown in FIG. 1. An attendant then places the toilet receptacle between the user's legs and raises it into the position shown in FIG. 1. The support arm 30 is then raised into an approximately horizontal position between the legs of the user to support the receptacle. The height of support arm assembly 47 is adjusted if necessary, using fasteners 34. After the receptacle 21 is installed, the user can proceed to use the toilet. The attendant can thereafter remove the receptacle 21 and dispose of the waste.

In the case of the embodiment shown in FIG. 5 the receptacle 21 must be tilted slightly while inserting the top front edge into catch 39. The bottom front edge of the receptacle can then be moved forwardly so as to rest on support arm 81.

It is also possible to have the attendant install and position the toilet receptacle 21 upon support arm assembly 47 prior to the user assuming his position within the walker framework 11. The narrow width of toilet receptacle 21 allows even severely handicapped persons to straddle the receptacle and to position themselves thereover.

The inventions disclosed herein can be easily constructed according to well-known manufacturing techniques preferably from metallic or plastic materials. The receptacle 21 is preferably made from a polymeric material which is flexible to accommodate the user's legs by flexing. Such manufacturing techniques would be readily apparent to one of ordinary skill in the art.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A standup toilet structure for attachment and use on a walker having a walker framework with an open side through which a standing user can move at least partially within the walker framework, comprising:

a toilet frame having at least one elongated bar adapted to extend vertically upon said walker framework;

means for connecting and supporting said elongated bar upon said walker framework in a vertical orientation;

support arm means connected to the elongated bar and extending transversely outward therefrom;

a toilet receptacle having relatively thin front and rear walls and relatively elongated side walls for allowing a user to stand astride thereof, said toilet receptacle being adapted to detachably mount upon said toilet frame and said support arm means with said thin front wall adjacent to said elongated bar; and means for detachably restraining said toilet receptacle upon said toilet frame;

whereby a user can support and stabilize himself or herself in a standing position at least partially within the walker while also standing astraddle the toilet receptacle and using the toilet structure.

2. The toilet structure of claim 1 adapted for use on walker frameworks having an upper front crossbar and lower front crossbar opposite from said open side of the walker framework wherein said frame includes an elongated bar which vertically extends between and is adapted for attachment to the upper front crossbar and the lower front crossbar of the walker framework.

3. The toilet structure of claim 2 wherein the elongated bar has a hooked end for engaging the upper front crossbar and an attachment means for securing the bar to the lower front crossbar.

4. The toilet structure of claim 1 wherein the toilet frame comprises a single elongated bar having an upper hooked end for hanging upon the walker framework and a detachable attachment means for interengaging with lower portions of the walker framework.

5. The toilet structure of claim 1 wherein said support arm means is pivotally attached to remaining portions of the toilet frame so as to be pivotable between an approximately horizontal position and an approximately vertical position.

6. The toilet structure of claim 5 further comprising a strut for supporting the support arm means in the approximately horizontal position.

7. The toilet structure of claim 5 wherein the support arm means is adjustably mounted upon said elongated bar and securable at a plurality of height positions.

8. The toilet structure of claim 1 wherein said means for detachably restraining extends outwardly and downwardly from said elongated bar to engage a top edge of the front wall of the toilet receptacle.

9. The toilet structure of claim 1 wherein the toilet receptacle is made of a polymeric material.

10. The toilet structure of claim 1 wherein said support arm means has a channel cross-sectional shape which receives a bottom of the toilet receptacle and prevents lateral motion thereof.

11. The toilet structure of claim 1 wherein said support arm means extends rearwardly a short distance upon which a bottom front edge of the toilet receptacle can rest.

12. The toilet structure of claim 1 wherein the toilet receptacle includes a deflector at a top rear portion thereof.

13. The toilet structure of claim 1 wherein the toilet receptacle is flexible to accommodate the user's legs.

14. A walker having a toilet structure incorporated thereinto, comprising:

a walker framework;

a support arm rigidly connected to the walker framework extending approximately horizontally a short distance from the walker framework so that the support arm does not impair use of the walker as an aid in walking;

a toilet receptacle supported upon the support arm; and a catch means attached to the walker framework at a position adjacent to a top of the toilet receptacle to retain the receptacle to the walker.

15. A standup toilet structure for attachment and use on a walker having a walker framework adapted to engage the ground or other supporting surface and extend upwardly therefrom to provide handles which can be grasped by a user, the walker framework being open along a back side so that a user can move therethrough and position himself at least partially within the walker framework, comprising:

a toilet frame adapted for attachment to the walker framework; the toilet frame including support arm means extendible outwardly in a cantilever arrangement;

a toilet receptacle having an open top sized to allow a user to straddle at least a portion of the toilet receptacle, said toilet receptacle being adapted to engage the support arm means and be supported thereon; and catch means attached to the toilet frame adjacent the open top of the toilet receptacle for engaging the toilet receptacle to aid in the support thereof.

* * * * *